United States Patent [19]

Ollis

[11] 3,933,120

[45] Jan. 20, 1976

[54] ALARM FOR DEEP FREEZER

[76] Inventor: Murrell W. Ollis, 125 Sunnybrook Drive, Bristol, Tenn. 37620

[22] Filed: Apr. 24, 1975

[21] Appl. No.: 571,334

[52] U.S. Cl. ..... 116/103; 62/125; 62/129; 116/70; 236/94

[51] Int. Cl.[2] ..... F25B 49/00

[58] Field of Search ..... 116/103, 102, 101, 70, 116/106; 62/129, 131, 125; 236/94; 73/368.3

[56] References Cited

UNITED STATES PATENTS

| | | | |
|---|---|---|---|
| 2,993,466 | 7/1961 | Sklaroff et al. | 116/103 |
| 3,461,834 | 8/1969 | Linder | 116/112 |
| 3,590,770 | 7/1971 | Wagner | 116/103 |

*Primary Examiner*—Richard C. Queisser
*Assistant Examiner*—Marcus S. Rasco
*Attorney, Agent, or Firm*—A. Yates Dowell, Jr.

[57] ABSTRACT

An apparatus for intermittently sounding an audible alarm when the temperature within a deep freezer rises to a predetermined level which is less than the freezing temperature of most food products so that steps can be taken to prevent the food products from thawing. The apparatus includes a remote bulb element which intermittently opens and closes a container of liquefied gas which is permitted to expand and sound an alarm when the freezer malfunctions.

9 Claims, 4 Drawing Figures

ALARM FOR DEEP FREEZER

BACKGROUND OF THE INVENTION

1. Field of the Invention

This invention relates to alarm systems of various kinds and relates particularly to an alarm system associated with a deep freezer to sound an audible warning when the temperature within the freezer rises to a predetermined level.

2. Description of the Prior Art

Heretofore alarm systems of various kinds have been provided which issue a warning when an associated mechanism is malfunctioning or when conditions, such as temperature, humidity and the like, surrounding the alarm mechanism change. As an example, many fire alarms have been provided which sound an alarm when the temperature within an area rises to a predetermined level to warn the occupants of a building to leave immediately or take appropriate action, such as extinguishing the fire. These alarms have been operated in many different ways including electrically and by pressurized gas and have included horns, bells, sirens, flashing lights and other warning signals; however, most of these alarms have operated continuously once they have been started.

Some efforts have been made to provide an alarm system for a deep freezer to warn the occupants of a building that the deep freezer is malfunctioning so that the occupants can take appropriate steps to preserve the frozen products within the freezer before the products are damaged or have spoiled through thawing. Some examples of the prior art are the U.S. Pat. Nos. to Bean 2,439,331; Wood 2,475,069; Iketani 3,360,165; Richardson 3,400,536; Linder 3,461,834; and Wagner 3,590,770.

SUMMARY OF THE INVENTION

The present invention is embodied in a self-contained intermittently operated warning system for a freezer which is operated automatically when the temperature within the freezer rises to a predetermined level substantially below the freezing temperature of the products within the freezer so that persons hearing the alarm can take appropriate action to prevent the food products within the freezer from being damaged or spoiled due to thawing. The warning system includes a remote bulb element having a bulb located within the freezer and which is connected by a capillary tube to a bellows or diaphragm member mounted exteriorly thereof. The capillary tube between the diaphragm member and the bulb is coiled about an evaporator to provide intermittent operation of the alarm. A connector which supports a container of liquefied refrigerant gas is mounted on the diaphragm member and communicates with the evaporator which has an audible alarm signal mounted thereon. When the temperature within the freezer reaches a predetermined level, the diaphragm member operates a valve carried by the container and releases liquefied refrigerant gas which is discharged into the evaporator where it changes state to a gas utilized for operating the alarm signal. The change of state from a liquid to a gas absorbs heat from the capillary tube of the remote bulb element and retracts the diaphgram of the diaphragm member which closes the valve to interrupt the signal. When the temperature within the freezer again causes the diaphragm of the remote bulb element to expand, the cycle is repeated until appropriate action is taken by the owner of the freezer to preserve the contents thereof.

It is an object of the invention to provide an alarm for a deep freezer including a self-contained system which intermittently sounds an audible alarm signal over an extended period of time when the temperature within the freezer reaches a predetermined level.

DESCRIPTION OF THE PREFERRED EMBODIMENT

Figure 1:
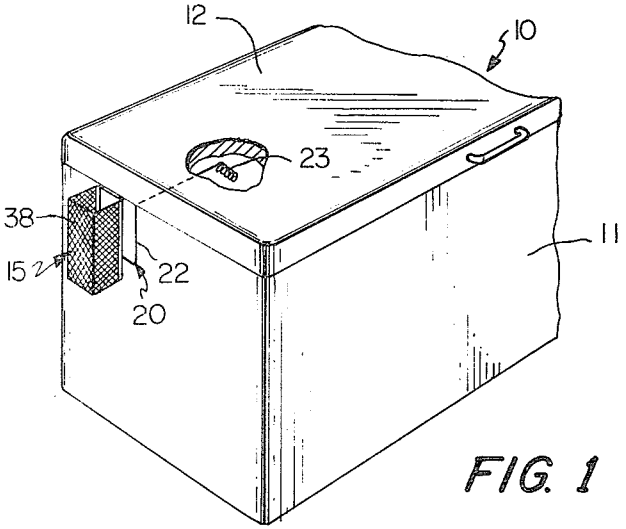
FIG. 1 is a perspective illustrating one application of the invention.
Figure 4:
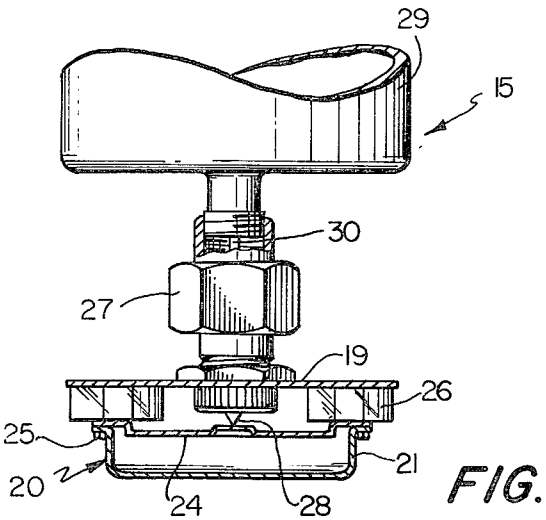
FIG. 4 is an enlarged section on the line 4—4 of FIG. 2.

With continued reference to the drawing, a freezer 10 is provided having a body 11 and a door or lid 12. Such freezer may be either of the chest type having a hinged lid, as illustrated in FIG. 1, or may be an upright type with a front opening door. The freezer 10 is provided with conventional refrigerating apparatus which normally maintains the temperature within the freezer at any desired level and ordinarily at approximately 0° F. Seals between the body 11 and the door or lid 12 resist the transfer of heat into the freezer so that the refrigerating apparatus is operated only intermittently to maintain a substantially constant temperature within the freezer. The structure thus far described is conventional in the prior art and forms no part of the invention.

At times a failure of electrical energy or a failure of the refrigerating equipment may occur without the knowledge of the owner of the freezer and therefore the temperature within the freezer may gradually rise to the point where thawing of the products within the freezer occurs in which case such products may be damaged or spoiled. Since most products thaw at approximately 32° F or 0° C, it is desirable to provide a warning system which operates before the temperature has risen to the thawing point to inform the occupants of the building that the freezer is malfunctioning and to maintain the warning signal over an extended period of time so that steps may be taken to prevent damage to the products within the freezer.

Figure 3:
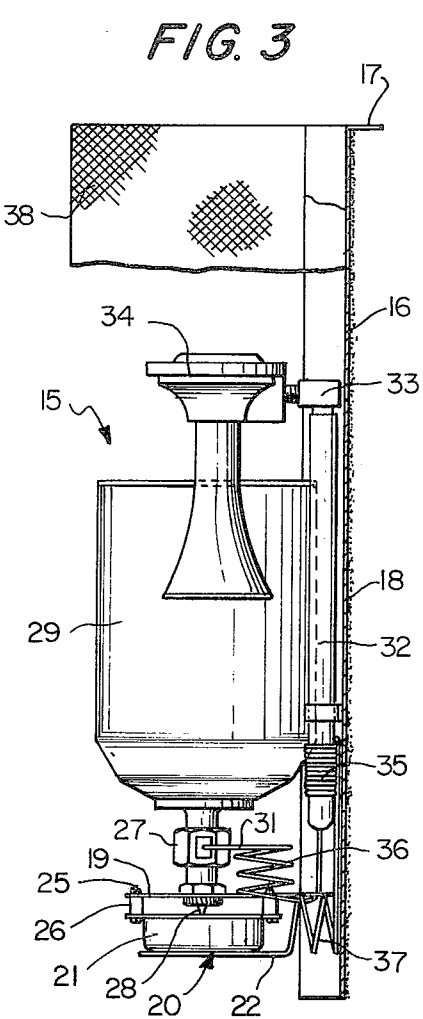
FIG. 3 is a side view thereof.
Figure 2:
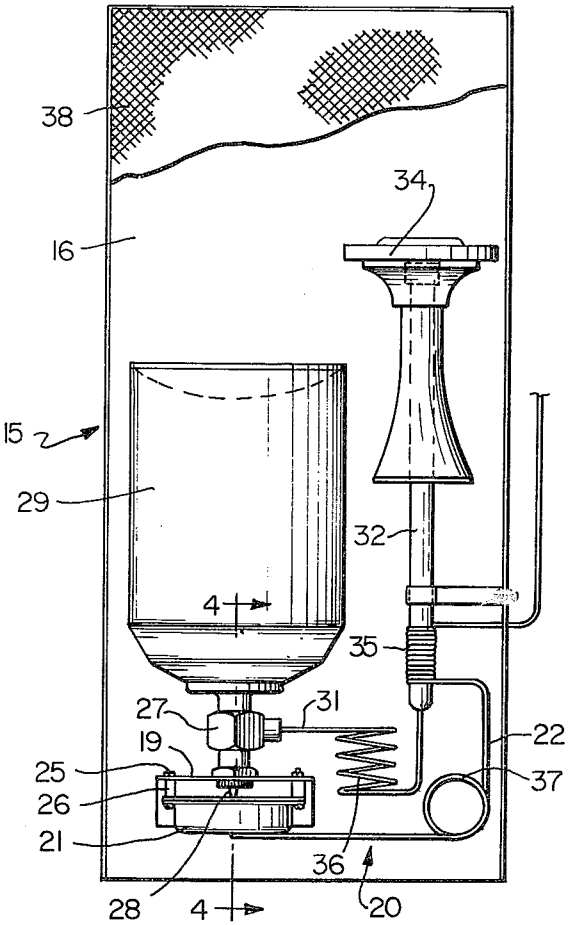
FIG. 2 is an enlarged front elevation of the alarm.

In order to do this, an alarm 15 is provided having a base or mounting plate 16 which can be mounted in any desired manner in a convenient location exteriorly of the freezer. As illustrated in FIG. 3, one or more ears or lugs 17 extend outwardly from the base 16 so that the mounting plate may be supported by the upper edge of the body 11 or the like. If desired an adhesive coating 18 may be applied to the rear surface of the base for mounting the base on a vertical surface as the side of the freezer. Also, one or more openings (not shown) may be provided in the base for supporting the base by nails, screws, hooks or the like. A platform or flange 19 is welded or otherwise attached to the lower portion of the base 16 and extends outwardly from the front face thereof.

A remote bulb element 20 is provided having a diaphragm member 21 connected by a capillary tube 22 to a bulb or coil 23 located within the freezer 10. The remote bulb element is filled with vapor, gas or liquid which is responsive to the temperature within the freezer so that changes in temperature at the bulb result in changes in pressure or volume which are communicated through the capillary tube to the diaphragm member. The diaphragm member 21 includes a diaphragm 24 which is mounted in spaced facing relationship with the bottom surface of the platform 19 by means of screws or other fasteners 25 passing through spacers 26. A connector 27 having an operating plunger 28 is mounted on the upper surface of the platform 19 with the plunger being in alignment with and substantially contacting the diaphragm 24.

A container 29 or other source of expansible fluid or liquefied gas under pressure, such as freon 12 (dichlorodifluoromethane), is mounted in airtight relationship on the connector 27 and such container has a plunger type valve 30 in alignment with and operated by the plunger 28 of the connector 27. A capillary tube 31, having an inside diameter of approximately 0.003 inch, is connected to the connector 27 and such capillary tube communicates with an expansion member or evaporator 32 in the form of a metal tube which can be of any desired diameter and length although a diameter of one-quarter inch and a length of approximately 5 inches has been found satisfactory. The opposite end of the expansion member 32 communicatess through a fitting 33 to a diaphragm type air horn 34. When the diaphragm 24 is operated, the plunger 28 is raised and the container valve 30 is unseated to permit liquefied gas to flow through the capillary tube 31 into the expansion member 32 where it expands and changes state from a liquid to a gas for operating the horn 34.

In order to cause the signal to be operated intermittently over a period of hours using a 10 ounce container of liquefied gas, the capillary tube 22 of the remote bulb element has a plurality of turns 35 wrapped around the expansion member 32 adjacent to the discharge end of the capillary tube 31 so that the change of state from a liquid to a gas absorbs heat from the capillary tube 22 and thereby reduces the pressure within the diaphragm member 21. The reduction of pressure causes the container valve to close and interrupt the discharge of liquefied gas from the container 29. When the temperature within the freezer again raises the pressure within the remote bulb element, the diaphragm 24 operates the plunger 28 and the cycle is repeated.

If desired the length of time that the audible signal is heard can be controlled by providing a coil 36 having a plurality of turns along the length of the capillary tube 31 and the length of the signal can be increased or reduced by adding or removing turns from the coils 36. Also the length of the time interval between the signals of the air horn can be regulated by providing a coil 37 in the capillary tube 22 between the turns 35 on the expansion member and the diaphragm member 21. The time interval between signals can be increased or reduced by adding or removing turns from the coil 37. Preferably the alarm is arranged to produce an audible signal of from 5 to 10 seconds duration each minute so that a thirty ounce can of freon 12 will produce intermittent sounds of the horn 34 for a period of from 9 to 10 hours. It is noted that a container or other source of expansible fluid of smaller or larger capacity can be provided which will reduce or extend the period of time over which the signal can be heard.

The apparatus is covered by a screen or an expanded metal housing 38 to protect the various elements of the alarm from being accidentally struck. As soon as the alarm signal has been recognized, the container 29 may be removed to preserve the remainder of the liquefied gas therein and appropriate action may be instituted to preserve the frozen products within the freezer.

In the operation of the device, the bulb 23 of the remote bulb element is initially placed within the freezer before the container 29 is mounted on the connector 27. After the bulb 23 has reached a temperature of 21° F or less, the container 29 is screwed into place on the connector 27 with the container valve in alignment with the plunger 28 so that the alarm is a self-contained unit which is ready to operate as soon as the temperature within the freezer exceeds 21° F. If the freezer should malfunction for any reason, such as a failure of electrical current or a failure of the refrigerating apparatus, the temperature within the freezer slowly increases. When the temperature increases to approximately 21° F or to some other predetermined value substantially less than the thawing point of the products within the freezer, the pressure within the remote bulb element increases and causes the diaphragm 24 to expand and operate the plunger 28. When the plunger is operated to open the valve 30 of the container 29, liquefied gas or other expansible fluid flows from the container through the capillary tube 31 and into the expansion member 32 where it changes state from a liquid to a gas and operates the air horn 34 to sound an audible signal.

The change of state of the liquid to a gas absorbs heat from the capillary tube 22 and reduces the pressure within the remote bulb element 20 so that the diaphragm 24 retracts and closes the container valve 30. When the pressure again builds up in the remote bulb element 20, the diaphragm 24 again is operated and the cycle is repeated. When the audible signal is heard, the owner of the freezer recognizes that the freezer has malfunctioned and can take appropriate steps to preserve the contents of the freezer, such as by adding a block of solid carbon dioxide or dry ice to the freezer as a temporary measure to maintain the contents of the freezer in a frozen state while repairs are being made, or the owner of the freezer can transfer the contents to another freezer before the contents are damaged or spoiled by thawing.

I claim:

1. A self-contained alarm for intermittently operating a signal when the temperature within a freezer rises to a predetermined value, said alarm comprising a remote bulb element having first and second portions connected by capillary tube means, said first portion including bulb means responsive to the temperature within said freezer, said second portion including diaphragm means located exteriorly of said freezer, a container of expansible fluid having valve means operatively associated with said diaphragm means, an expansion member communicating with said container, said capillary tube means of said remote bulb element having portions located adjacent to said expansion member, and signal means operated by fluid within said expansion member, whereby an increase in pressure in said remote bulb element caused by a rise in temperature within the freezer opens the valve means of said container to discharge expansible fluid into said expansion member where the fluid expands and operates said signal and the expansion of said fluid absorbs heat from said remote bulb element to reduce the pressure therein and close the valve means of said container to interrupt the flow of fluid therefrom.

2. The structure of claim 1 including a second capillary tube means providing communication between said container and said expansion member.

3. The structure of claim 2 in which said second capillary tube means includes a coil for regulating the length of the signal.

4. The structure of claim 1 in which the portions of said capillary tube means adjacent to said expansion member include a plurality of turns around said expansion member and in engagement therewith.

5. The structure of claim 1 in which said signal means includes a diaphragm type horn.

6. The structure of claim 1 including a connector mounted on said container and plunger means carried by said connector and engageable with said container valve means and said diaphragm means to operate said valve means when said diaphragm means is expanded.

7. The structure of claim 1 in which said capillary tube means includes a coil for regulating the period of time between signals.

8. Apparatus for intermittently operating a signal when the temperature within a freezer rises to a predetermined value less than the thawing point of the products within the freezer comprising a base, a remote bulb element including bulb means responsive to the temperature within a freezer and a diaphragm member mounted on said base and first capillary tube means providing communication between said bulb means and said diaphragm member, said diaphragm member including a diaphragm which is expanded and contracted by variations in pressure within said remote bulb element caused by temperature changes at said bulb means, a container of liquefied gas mounted on said base and having valve means operatively associated with said diaphragm, an expansion member having signal means mounted thereon, and second capillary tube means providing communication between the valve means of said container and said expansion member, whereby an increase in pressure in said remote bulb element caused by a rise in temperature to approximately 21° F within the freezer opens the valve of said container to discharge liquefied gas from said container into said expansion member where the liquid changes state to a gas which operates said signal and the change of state absorbs heat from said remote bulb element to reduce the pressure therein so that the valve means of said container closes and interrupts the flow of liquid from said container.

9. A self-contained alarm for intermittently operating a signal when the temperature within a freezer rises to a predetermined value, said alarm comprising a remote bulb element having first and second connected portions, said first portion including means responsive to said freezer temperature, said second portion including means located exteriorly of said freezer, a source of expansible fluid having valve means operatively associated with said second portion of said remote bulb element, expansion means communicating with said valve means, said connecting means of said remote bulb element having portions located adjacent to said expansion means, and signal means operated by fluid within said expansion means, whereby an increase in pressure in said remote bulb element caused by a rise in temperature within the freezer opens the valve means of said source of fluid to discharge fluid into said expansion means where the fluid operates said signal and the fluid absorbs heat from said remote bulb element to reduce the pressure therein and close the valve means of said source of fluid to interrupt the flow of fluid therefrom.

* * * * *